US005218830A

United States Patent [19]

Martineau

[11] Patent Number: 5,218,830

[45] Date of Patent: Jun. 15, 1993

[54] SPLIT SYSTEM ICE-MAKER WITH REMOTE CONDENSING UNIT

[75] Inventor: Tom N. Martineau, Erie, Pa.

[73] Assignee: Uniflow Manufacturing Company, Erie, Pa.

[21] Appl. No.: 850,874

[22] Filed: Mar. 13, 1992

[51] Int. Cl.[5] ..... F25C 5/10

[52] U.S. Cl. ..... 62/73; 62/160; 62/174; 62/352; 62/509

[58] Field of Search ..... 62/352, 151, 137, 324.1, 62/324.3, 324.4, 324.5, 174, 509, 160, 188, 205, 71, 73

[56] References Cited

U.S. PATENT DOCUMENTS

| | | | |
|---|---|---|---|
| 2,598,429 | 5/1952 | Pownall | 62/106 |
| 2,882,695 | 4/1959 | Zwickl | 62/174 X |
| 2,942,432 | 6/1960 | Muffly | 62/155 |
| 2,949,750 | 8/1960 | Kramer | 62/196 |
| 3,026,686 | 3/1962 | Lowe | 62/352 X |
| 3,055,185 | 9/1962 | Lundstrom | 62/138 |
| 3,187,516 | 6/1965 | Lundstrom | 62/138 |
| 3,637,005 | 1/1972 | Nussbaum | 62/174 X |
| 3,769,808 | 11/1973 | Kramer | 62/509 X |
| 4,266,405 | 5/1981 | Trask | 62/324.4 X |
| 4,276,751 | 7/1981 | Saltzman et al. | 62/352 X |
| 4,423,603 | 1/1984 | Oguni et al. | 62/324.1 |
| 4,455,843 | 6/1984 | Quarles | 62/352 X |
| 5,105,632 | 4/1992 | Naruse | 62/352 |

*Primary Examiner*—Harry B. Tanner
*Attorney, Agent, or Firm*—Collard & Roe

[57] ABSTRACT

A split system ice-maker having a main unit, which houses the ice-making evaporators, and a remote unit, which houses an accumulator, a compressor and a condenser. At least two refrigeration lines are provided which connect the main unit to the remote unit. A four-way valve is located in the remote unit which directs the flow of refrigerant from the compressor to the condenser and then to the evaporator, during an ice-making mode, and additionally directs the flow of refrigerant directly to the evaporators during a harvest mode. The reversed flow in harvest mode briefly defrosts the evaporators, containing the ice-making grid, facilitating harvesting of the ice.

15 Claims, 8 Drawing Sheets

STATUS OF REFRIGERANT CONTROL VALVES DURING VARIOUS MODES OF OPERATION

| COMPONENTS | ICE MAKING MODE | HARVEST MODE | PUMP-DOWN MODE |
|---|---|---|---|
| FOUR-WAY VALVE (20) | CONNECTS LINE 18 TO LINE 28 AND CONNECTS LINE 14 TO ACCUMULATOR 24 AND COMPRESSOR 16 | CONNECTS LINE 18 TO LINE 14 AND CONNECTS LINE 28 TO ACCUMULATOR 24 AND COMPRESSOR 16 | CONNECTS LINE 18 TO LINE 28 |
| HARVEST SOLENOID VALVE (38) | CLOSED | OPEN | CLOSED |
| LIQUID LINE SOLENOID (54) | OPEN | OPEN OR CLOSED | CLOSED |
| COMPRESSOR 16 AND CONDENSER FAN 32 | ON | ON | ON-OFF |

FIG. 7

SPLIT SYSTEM ICE-MAKER WITH REMOTE CONDENSING UNIT

BACKGROUND OF THE INVENTION

The invention relates to the art of ice-making machines, and more particularly, to an improved ice-making machine wherein the heat and noise producing components are installed at a remote location, apart from the evaporator.

Typically, large ice-makers that are found in hotels, restaurants and commercial establishments take up significant floor space, and are noisy. They also have the further disadvantageous effect of producing a tremendous amount of heat at the site where they are located. Their size, noise and heat production typically limits where they can be located. Moreover, where conventional ice-makers require servicing, the technicians would typically be in a high traffic area in order to access the ice-maker. In order to overcome these disadvantages, the present invention provides an ice-making machine wherein the compressor and condenser are separated from the ice-making evaporator to eliminate much of the heat and noise associated with conventional ice-making machines.

PRIOR ART

At least one attempt has been made to provide a remote ice-making system. This is described in U.S. Pat. No. 4,276,751, to Saltzman et al, which discloses a typical hot gas system which is well-known in the art. During ice-making, chilled refrigerant passes through a remote line to the evaporator and then returns on a return line. During harvesting, hot gas is pumped to the evaporator through a third remote line and returns on the same, common return line. The patent to Saltzman et al has several drawbacks in that the thermodynamics of such a system do not permit the compressor to be located any great distance from the evaporator. Additionally, to the extent that it can be placed remotely, three lines are required between the two units, and the refrigerant, condensed in the evaporator during harvest is returned directly to the compressor rather than being evaporated in a second heat exchanger, as in the present invention.

SUMMARY OF THE INVENTION

It is, therefore, an object of the present invention to eliminate the aforementioned drawbacks of the prior art and to provide a split system ice-maker, wherein the components, compressor and condenser are located separately from the ice-making unit to isolate the heat and noise producing components from the ice making section.

It is a further object of the present invention to provide an ice-making evaporator which is sufficiently small that it can be placed in many locations which are not currently feasible with state of the art ice-makers.

It is a further object of the present invention to provide a split-system ice maker wherein the remote condensing unit is capable of operating at greatly reduced ambient temperatures and still be capable of generating sufficient heat to adequately harvest ice.

It is still a further object of the invention to provide an ice-making system that is simple in design, easy to maintain, and reliable in operation.

BRIEF SUMMARY OF THE INVENTION

These and other related objects are achieved, according to the invention, by a split system ice-maker which operates like a heat pump and utilizes a four-way valve. The evaporator ice-maker and the receiver is designed as one unit to be placed wherever ice-making capacity is desired. It is believed that currently existing ice-making evaporator units can be used for this purpose. The evaporation unit is connected by two remote lines to a second unit, comprising the accumulator, compressor and condenser. Also at the second location is a four-way valve which controls the flow of refrigerant during the various cycles.

In the ice-making mode, the four-way valve directs refrigerant from the compressor through the condenser, and then along a first remote line to the ice-making evaporators. A second remote line at the output of the evaporators is connected to the input side of the compressor via the four-way valve. In the ice harvest mode, the compressor output is directed through the second remote line to the evaporator ice-makers, and then through the first remote line to the condenser. From the condenser, the four-way valve permits the refrigerant to reach the input side of the compressor. In the pump down mode, the valve only permits the refrigerant to flow from the compressor through the condenser along the first remote line to be collected in the receiver, which is located in the vicinity of the evaporators.

Thus, the four-way valve permits the condenser and evaporator to switch functions between the ice-making and ice harvesting cycles, so that the entire system operates like a heat pump. That is, during the ice-making mode, the condenser and evaporator operate normally. However, during ice harvesting, the ice-making unit, or evaporator, has to be heated to release the ice into the ice collection bin. The hot compressor output is thus fed to the evaporators which absorb heat from the refrigerant, like a condenser. As the refrigerant returns, it passes through capillary tubes, which operate as an expansion valve, and chills the condenser upon contact, like an evaporator.

Since the condenser and evaporator both operate as heat exchangers, and since they reverse roles, the system is analogous to a heat pump. However, a heat pump has basically a single loop in which all the components are attached. During the reverse cycle, the flow of refrigerant is merely reversed in the loop. The heat pump is equipped with a two-way flow restricter which is disposed between the two heat exchangers, which are generally near each other. Thus, whichever way the refrigerant flows, it encounters a heat exchanger shortly after exiting the two-way flow restricter.

In the present invention, it is desirable to have one heat exchanger, the ice-making evaporator, indoors where ice-making capacity is desired, and the other heat exchanger, the condenser, located outdoors, where the majority of heat can be dissipated.

The ice-making mode operates for approximately 12 minutes, during which time the condenser heats up considerably. Then the ice harvest mode operates for approximately one to two minutes. During this time, the ice-making grid, which is surrounded by ice, is heated by the hot gas output of the compressor just enough to melt the bond of the ice to the evaporator so that the ice is removed by gravity. During the ice harvest mode, which lasts only a short time, the indoor heat exchanger, i.e., the evaporator, does not dissipate heat into the room because the evaporator is only heated enough to allow the removal of the ice. An additional benefit is realized at the remotely located outdoor heat exchanger, i.e., the condenser, in that it is momentarily chilled, due to the introduction of refrigerant undergoing a drastic decrease in pressure. This results in a greater efficiency when the unit cycles back to its ice-making mode.

The compressor and condenser portions of the system are preferably placed outdoors behind restaurants and bars, similar to a small central air-conditioning compressor. In large buildings, such as hotels, the outdoor unit could be placed on the roof, up to 100 or more feet away from the evaporator.

In another embodiment, several ice-making evaporators could be driven by a single large compressor unit. This eliminates the heat, noise and vibration of the compressor from the occupied areas surrounding the ice-making evaporator(s). It is believed that by moving this source of heat outdoors, one or more tons of additional air conditioning capacity can be saved.

The invention discloses several features which allow it to operate without a two-way flow restriction. It should be pointed out that there are only two lines between the indoor and outdoor units. The refrigerant flow is reversed in these lines during the two modes of operation. Thus, to an extent, the invention is a single loop, like a heat pump, if the indoor and outdoor units are thought of as individual components. However, a consideration of the refrigerant flow within the indoor and outdoor units reveals a different situation.

Since the heat exchangers are in different locations, each has its own flow restricter following a liquid line solenoid. For the ice-making evaporators, the flow restricter is in the form of an expansion valve. For the condenser, the flow restricter in a preferred embodiment is in the form of two 0.064" diameter capillary tubes about 30" long, for example. When a flow restricter is not required, the liquid line solenoid shuts and refrigerant is routed through other lines which are provided.

In essence, each liquid line solenoid and its respective flow restricter operates in one direction during one mode. The four-way valve allows the refrigerant flow to be reversed, so as to accommodate the various components.

Two lines are connected to the input side of each heat exchanger. One of those lines, as discussed above, carries a liquid line solenoid ahead of a flow restricter. The second line carries a check valve which only permits flow away from the heat exchanger. When a heat exchanger is operating as an evaporator, its liquid line solenoid is open. The check valve associated with that evaporator is closed, due to the high pressure upstream from the check valve, i.e., upstream from the flow restriction. Since the check valve is closed, there is essentially one line on the input side of the evaporator containing a flow restricter.

When a heat exchanger operates as a condenser, refrigerant flows away from the unit through the check valve. Since the liquid line solenoid is closed, there is essentially one line containing the check valve leaving the heat exchanger.

There is also a receiver located in the indoor unit which has several check valves surrounding it. The purpose of this is to cycle refrigerant through the receiver continuously, regardless of the mode of operation. This is done to provide proper operation and start up in cold ambient conditions (i.e., −20° F.). During an "idle time" when no ice is being produced and the system is in what is called the "pump down" mode of operation, the majority of the refrigerant is collected in the receiver. When the receiver is located in the outdoor section, it is subjected to the outdoor ambient temperature. Consequently, the equalization pressure corresponds to the ambient temperature. In extremely cold ambients, this does not provide enough pressure differential between the "high" side and the "low" side to start the system. With the majority of the refrigerant charge in the high side (receiver) from pump down, a pressure difference is needed in order to allow the refrigerant to flow to the low side during start up. The compressor will not receive any refrigerant to "pump" until this occurs.

By placing the receiver in the indoor unit, it will not be subjected to the extremely cold ambient temperatures mentioned previously. This allows the equalization pressure to be at the corresponding room ambient temperatures (generally between 65° F. and 80° F.).

To demonstrate how temperature affects the equalization pressure, the following is provided.

| Temperature | Equalization Pressure (R-22) |
|---|---|
| −20° F. | 10.1 psig |
| 65° F. | 113.2 psig |
| 80° F. | 143.6 psig |

There is a method of accomplishing these pressures if the receiver is located in the outdoor section. A strip heater can be placed around the receiver and operated from a temperature control. This becomes an added expense, and requires additional parts which are subject to failure.

Placing the receiver in the indoor unit does not detract from any of the benefits accomplished by this split system refrigeration scheme. The receiver has no moving parts (no noise) and does not reject any appreciable amount of heat.

A check valve is located at the condenser outlet in the outdoor section. A solenoid valve is provided at the capillary tube inlets. These two devices keep the refrigerant from flowing back into the condenser during the cold ambient pump down mode while the compressor is off. Refrigerants will migrate to the coldest location (in this case, it would have been the condenser). By eliminating this migration, the refrigerant is contained in the receiver, as desired, as the "high side" pressure remains as described previously.

BRIEF DESCRIPTION OF THE DRAWINGS

FIG. 7 is a table showing the status of the control valves during various modes of operation.

DETAILED DESCRIPTION OF THE PREFERRED EMBODIMENT

Figure 1:
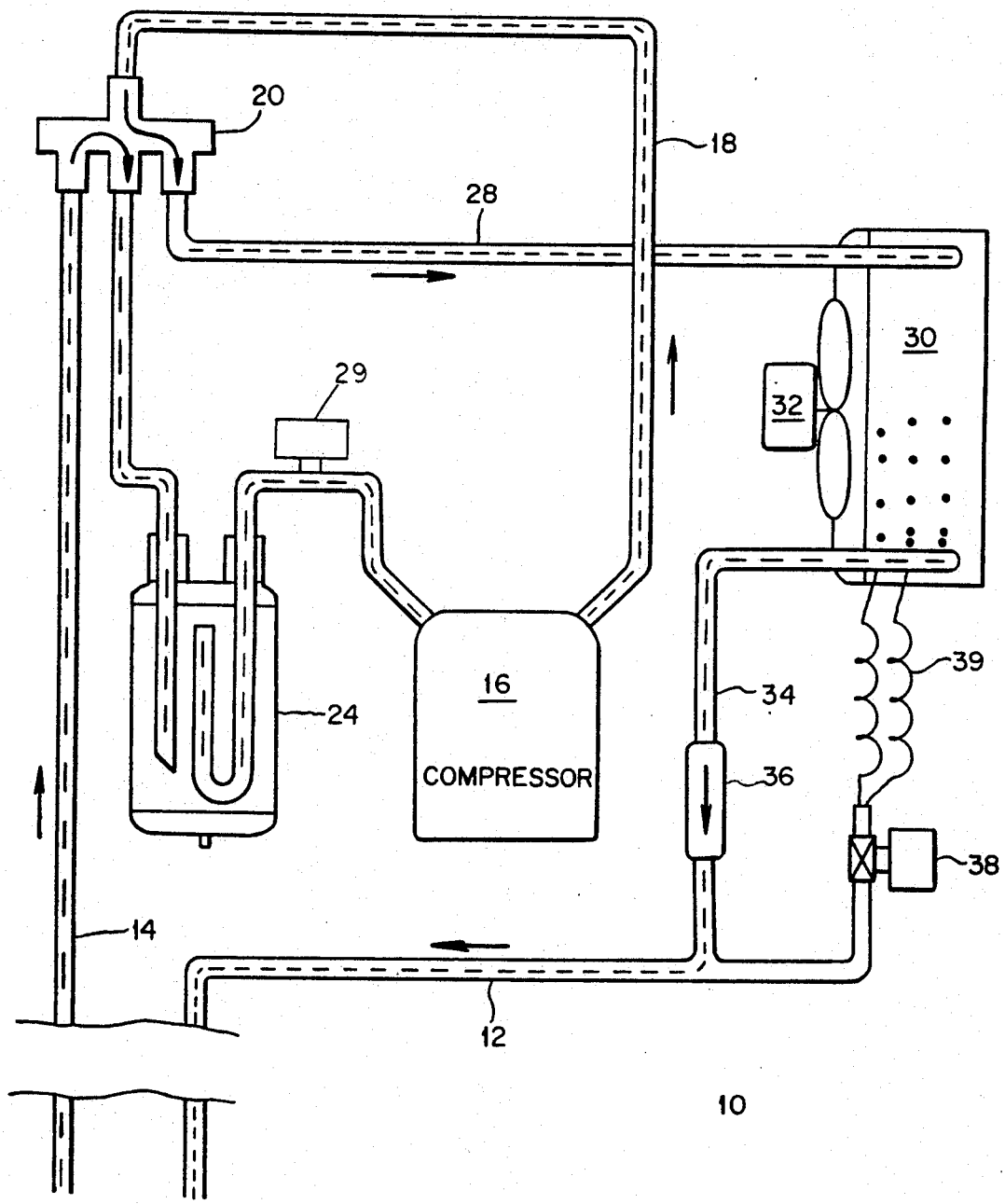
FIG. 1 is a schematic drawing of the outdoor unit in ice-making mode.
Figure 2:
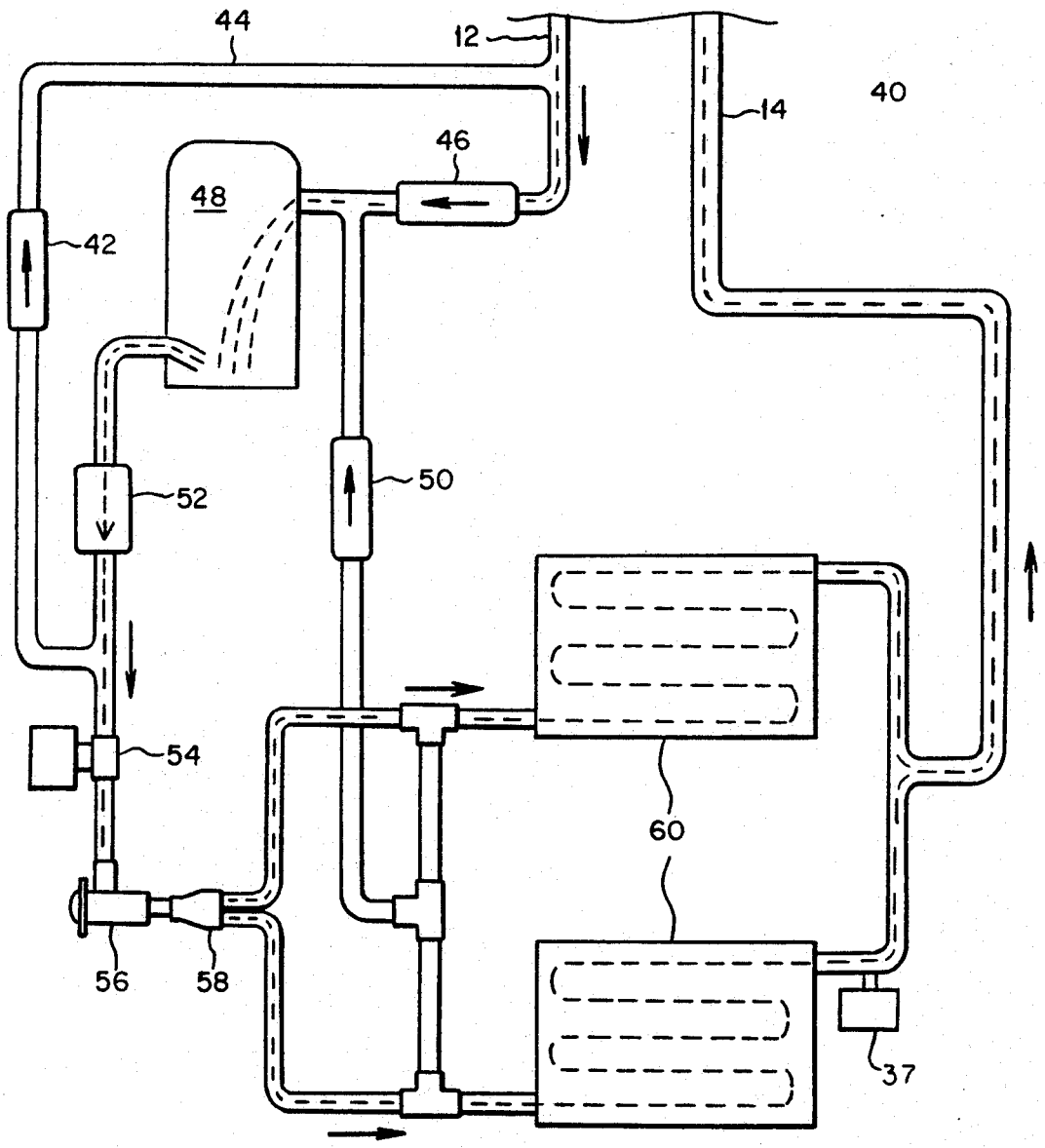
FIG. 2 is a schematic drawing of the indoor unit during ice-making mode.

Referring now in detail to the drawings, and, in particular, to FIG. 1, there is shown the outdoor unit of a split system ice-maker embodying the present invention. The outdoor unit is denoted generally by numeral 10. Outdoor unit 10 is connected to the indoor unit, which is generally denoted by unit 4 (as shown in FIG. 2) through remote lines 12 and 14. It should be noted that remote lines 12 and 14 switch positions as they extend from FIG. 1 to FIG. 2. (This also occurs when the remote lines extend from FIG. 3 to FIG. 4; and when the remote lines extend from FIG. 5 and FIG. 6.)

Outdoor unit 10 and indoor unit 40 form a closed system similar to that of an air-conditioner, refrigerator, or central air conditioning system. The system is charged to a predetermined level with a refrigerant, for example, FREON TM.

As shown in FIG. 1, in the ice-making mode, a compressor 16 discharges high temperature, high pressure, superheated refrigerant vapor, for example, FREON TM, along a line 18 to a four-way valve 20. Valve 20 permits refrigerant to pass through a line 28 to a condenser 30 in ice-making mode. Assisted by a fan 32, condenser 30 converts the refrigerant to a sub-cooled liquid refrigerant. Leaving the condenser, along a line 34 through a check valve 36, the refrigerant proceeds through line 12 to the indoor unit 40 (as shown in FIG. 2). Refrigerant is prevented from traveling along a line 44, due to a check valve 42, which is located in line 44. Instead, the refrigerant passes through a check valve 46 to a receiver 48. The refrigerant is prevented from flowing directly to the evaporators, due to a check valve 50. Upon leaving the receiver, the refrigerant passes through a filter dryer 52 and through a liquid line solenoid 54. The refrigerant then encounters an expansion valve 56 and a distributor 58 before reaching one or more evaporators 60.

The refrigerant flow path is completed when the low temperature, low pressure vapor returns on line 14 to valve 20, as shown in FIG. 1. The refrigerant is then routed through accumulator 24 to compressor 16.

Ice-making evaporator 60 is of a conventional design. For example, the ice cubes can be formed in one or more vertically or horizontally disposed freezing surfaces, the back side of which is disposed adjacent to the evaporator. A charge of water is circulated over the freezing surface or ice making grid. The quantity of water used for each cycle is slightly greater than that needed for ice-making for each harvest cycle. In one embodiment, the charge of water trickles down over a vertically disposed grid surface from the top, and begins freezing to the walls of the grid. With the grid in a vertical orientation, the sediment and minerals in the water settles in a collection tank below the grids, instead of ending up in the ice cubes. Eventually, at the end of the ice-making cycle, when the ice cubes are fully formed in each grid, the remaining water is flushed out of the system. With such a configuration, the ice-making mode takes about 12 minutes to complete in the preferred embodiment. In the embodiment shown, a pair of ice-making evaporators 60 are mounted against a pair of ice cube grids, as shown in FIG. 2.

Figure 3:
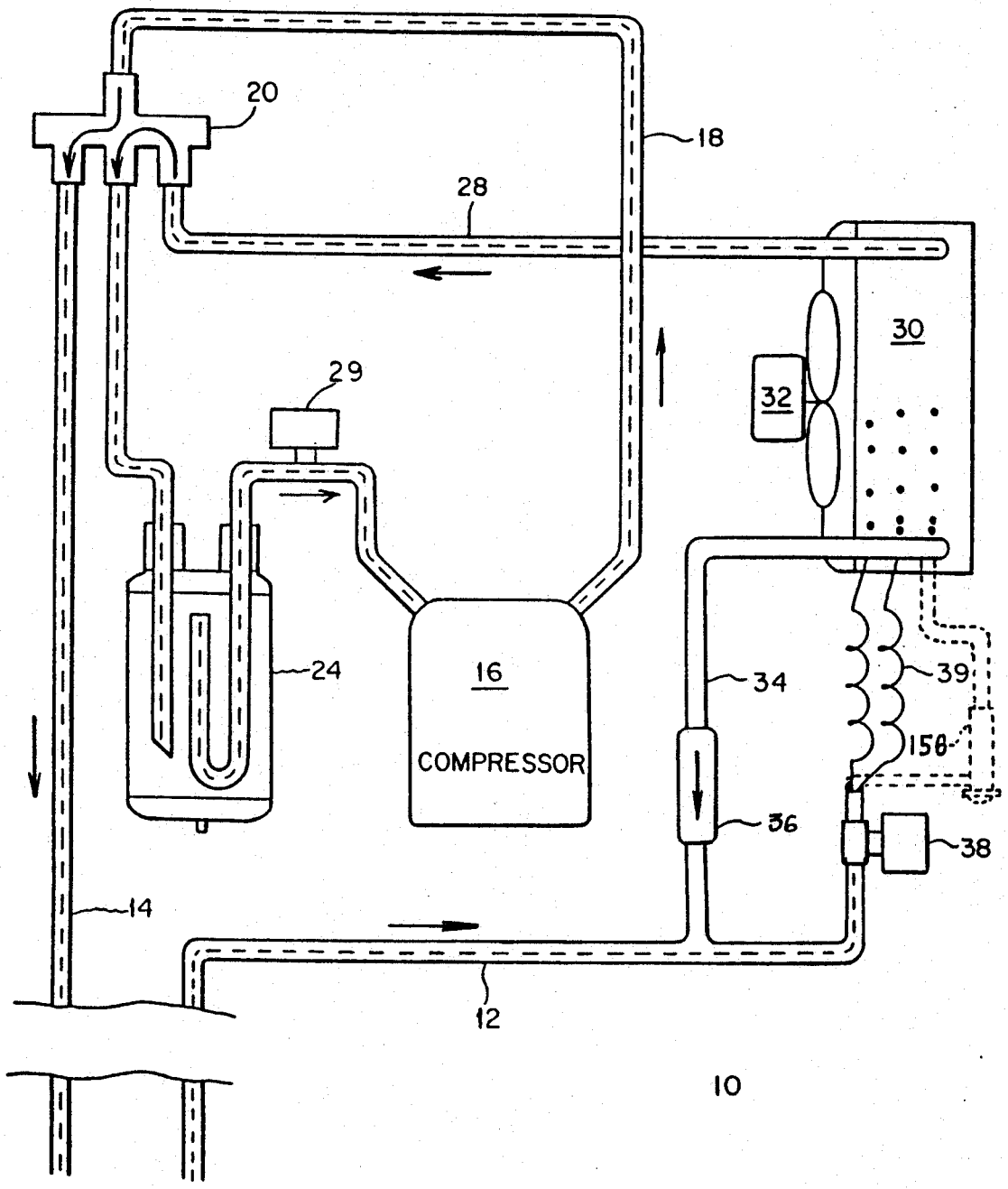
FIG. 3 is a schematic drawing of the outdoor unit during harvest mode.
Figure 4:
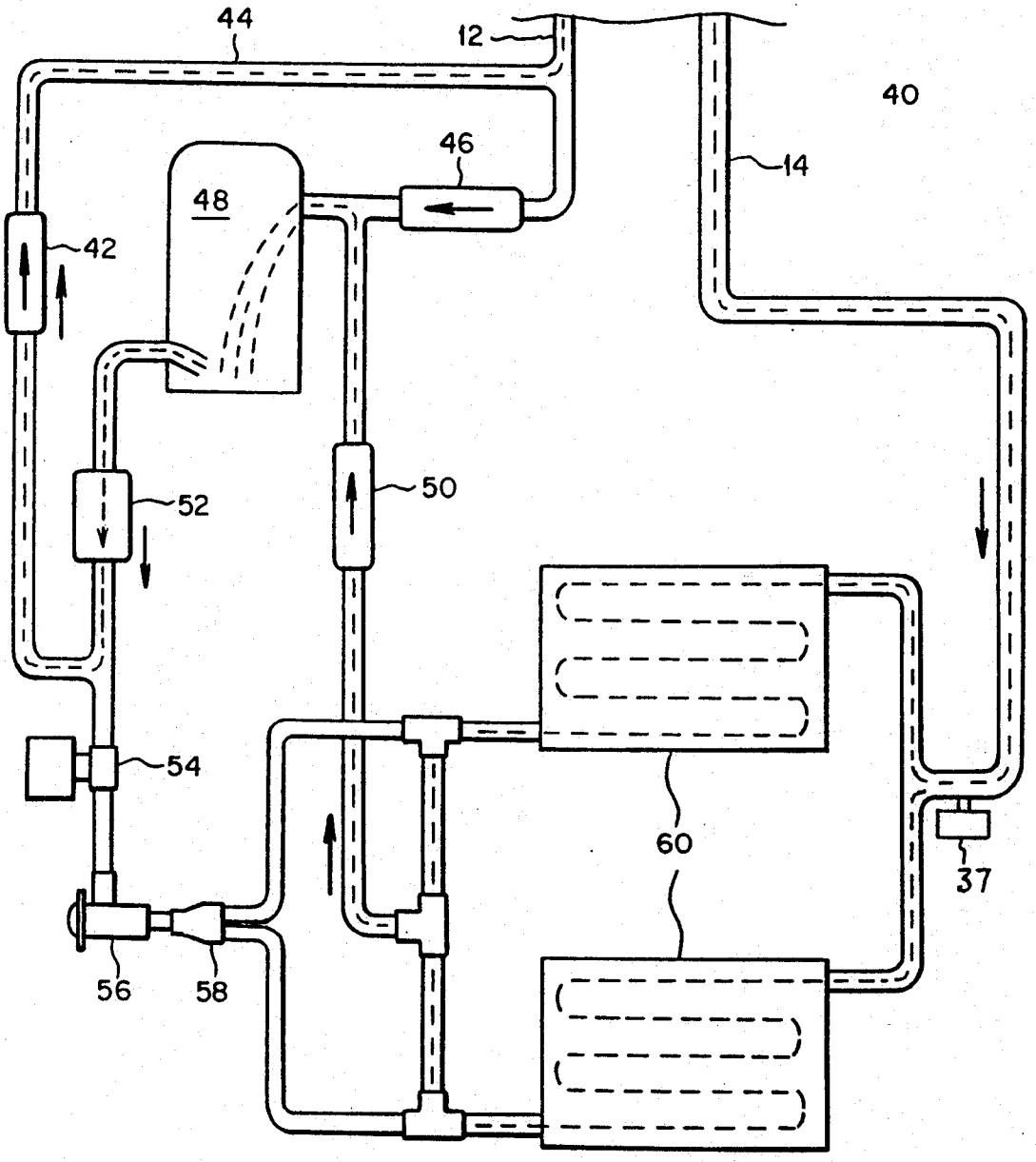
FIG. 4 is a schematic drawing of the indoor unit during harvest mode.

After the ice-making cycle has been completed, for example, after 12 minutes, the system shifts to its ice harvest mode. FIGS. 3 and 4 illustrate the flow of refrigerant during harvest mode. The major difference between ice-making mode (from FIGS. 1 and 2) and harvest mode (from FIGS. 3 and 4) is that four-way valve 20 routes the hot compressor output directly to ice-making evaporators 60, and condenser 30 output is routed through accumulator 24 to compressor 16. Also, a solenoid valve 38 is now open, and solenoid 54 in this embodiment is now closed, but does not necessarily have to be closed.

The ice-maker operates very much like a heat pump in the following sense. The refrigerant flow is reversed in the ice harvest mode from that of the ice-making mode so that condenser 30 in FIG. 3 now operates as an evaporator, and evaporators 60 in FIG. 4 now operate as a condenser. During the harvest mode, refrigerant leaves valve 20 as high-temperature, high-pressure, superheated refrigerant vapor and travels along line 14 to evaporators 60, which are now functioning as condensers. Due to the low temperature of evaporators 60, the refrigerant is converted to a sub-cooled liquid. Since liquid line solenoid 54 is closed, at this point, refrigerant flows through a check valve 50 and into receiver 48, since check valve 46 prevents any flow into line 12. After passing through filter-dryer 52, the refrigerant returns through check valve 42, line 44 to line 12. As can be seen in FIG. 3, since check valve 36 prevents flow, and since solenoid valve 38 is open during harvest, refrigerant flows through a pair of capillary tubes 39 to condenser 30, which now operates like an evaporator. In a preferred embodiment, the capillary tubes were 0.064" in diameter and about 30" long. As an alternative embodiment, solenoid valve 38 and restricters 39 can be replaced with a thermostatic expansion valve 156 similar to valve 56 (see FIG. 5). Upon leaving condenser 30, the refrigerant is converted to a low temperature, low pressure vapor. The flow is directed along line 28, through valve 20, back to accumulator 24 and compressor 16.

There is also a third mode of operation called the "pump down" mode. Pump down is a mode of operation during which no ice is made. For example, this occurs when the ice bin is full. Refrigerant flow during the pump down mode can be seen in FIGS. 5 and 6. Pump down mode operates very similarly to the ice-making mode. This causes the refrigerant to generally collect in receiver 48 and remote line 12.

Figure 5:
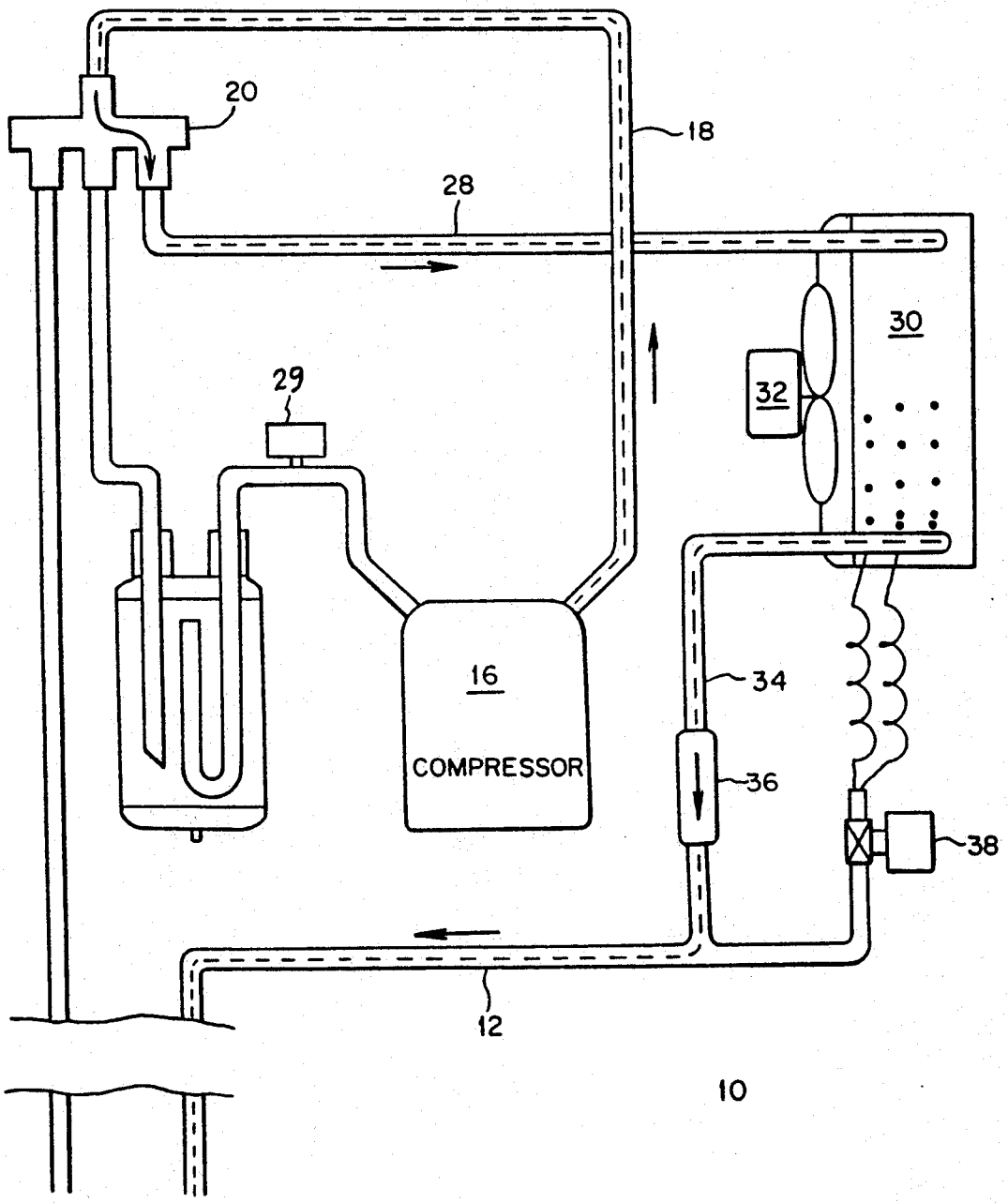
FIG. 5 is a schematic view of the outdoor unit during pump down mode.
Figure 6:
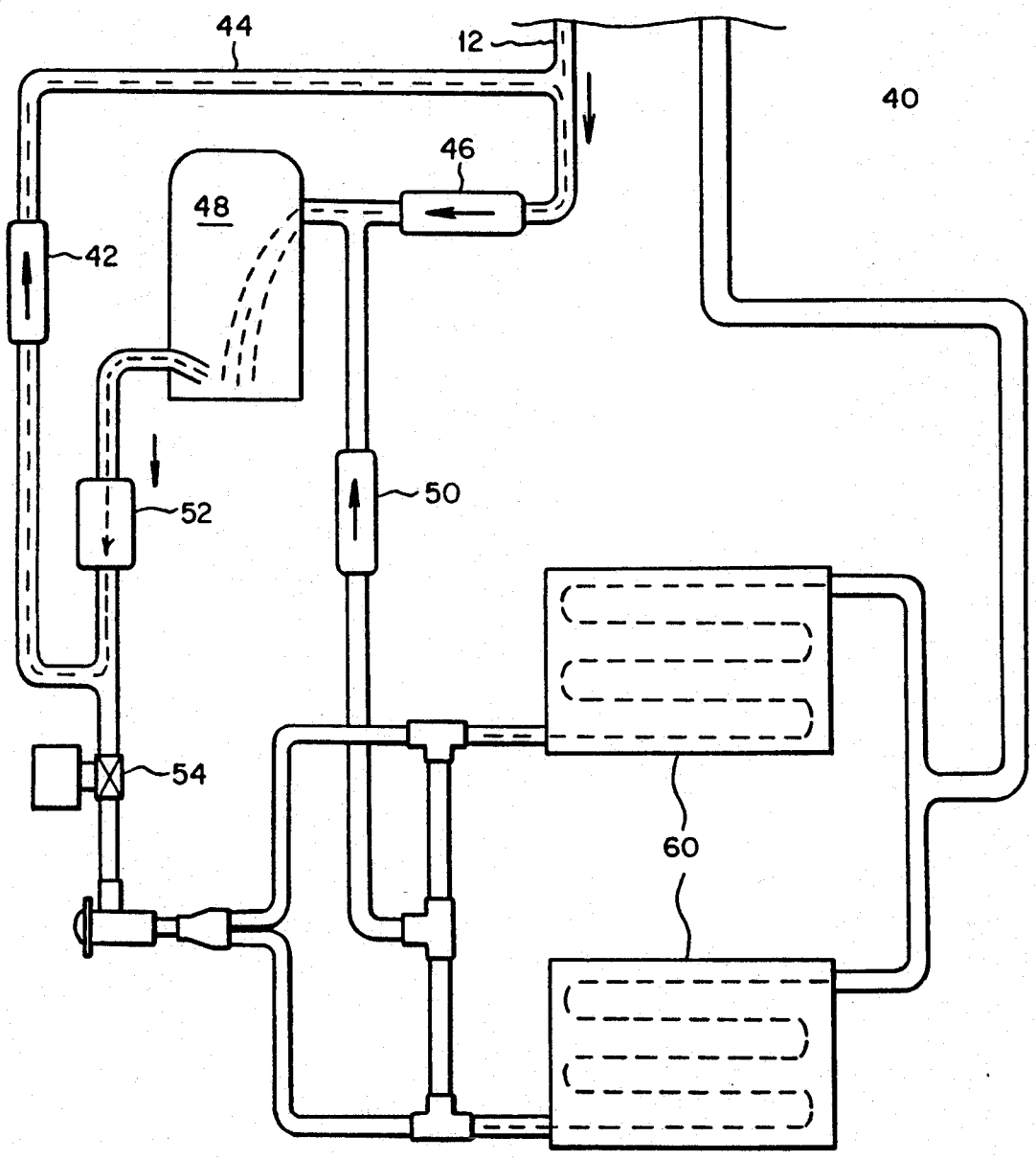
FIG. 6 is a schematic drawing of the indoor unit during pump down mode.

As can be seen in FIG. 5, during pump down mode, compressor 16 forces high temperature, high pressure super-heated refrigerant through line 18 to valve 20. The refrigerant is then routed along line 28 to condenser 30. Assisted by fan 32, condenser 30 converts the refrigerant to a sub-cooled liquid refrigerant. The refrigerant then passes along line 34, through check valve 36, to line 12. As can be seen in FIG. 6, refrigerant passes from line 12 through check valve 46, into receiver 48. Up until now, the refrigerant flow is identical to the flow in ice-making mode. The longer the pump down mode lasts, the more refrigerant will collect in receiver 48. In the pump down mode, the refrigerant is never converted to a low temperature, low pressure vapor as during the ice-making mode or harvest modes. This is due to the fact that although the refrigerant passes through condenser 30, it never gets to evaporators 60, but it merely collects in receiver 48 and liquid line 12.

Receiver 48 also provides another important function. The three check valves around receiver 48, namely check valves 42, 46 and 50, allow the refrigerant to flow through the receiver during both ice-making and harvest modes. This keeps the same volume of refrigerant in circulation during both modes of operation to provide a balanced system. This also directs the refrigerant flow, in one direction, through filter dryer 52 in all modes of operation. Moreover, in the pump down mode, refrigerant builds up in receiver 48, thus maintaining the "high side" pressure. As is known from the prior art, a pressure difference is needed in order to allow the refrigerant to flow to the evaporators 60 during start-up. The compressor will not start unless it receives refrigerant at its input end.

The ice-making mode and harvest mode are basically the two phases known from heat pumps. As can be appreciated, the functions of the evaporator and condenser are reversed during harvest mode. Also, the system utilizes only two lines, unlike conventional hot gas ice-making systems. Generally, heat pumps have a two way flow restricter. The present invention, however, contains two separate flow restricters, namely, expansion valve 56 (as seen in FIG. 2) and capillary tubes 39. Also, the remote unit, as shown in FIGS. 1 and 3, which is ideally placed outdoors, can be subjected to extremely cold ambient temperatures without affecting its function. The refrigerant evaporates into a vapor state prior to entering the compressor and heat is added to the refrigerant to aid in harvesting. In addition, condenser 30 is chilled during the ice harvest mode, thus providing for increased efficiency when the unit returns to its ice-making mode.

The remote unit, which houses compressor 16 and fan 32, can operate on a 220 volt power line as is standard for large air conditioning or refrigeration units. Single phase or three phase electrical service is ideally provided. The ice-making section can operate on 115 volt, single phase service, which is more readily available in interior areas. The ice making unit and the remote units can be connected via a low voltage or 24-volt AC control circuit. Other than lines 12 and 14, this control circuit is the only other connection that is required between the indoor and remote units. The control circuit synchronizes the operations of the indoor unit with the remote unit. For example, after the ice-making cycle, which is approximately 12 minutes long, the unit would go into its harvest mode. Thus, valve 20 switches over, solenoid valve 38 opens, and liquid line solenoid 54 can be closed. The operations in the indoor unit are controlled in conjunction with the functions of the remote unit. The harvest mode continues for one to two minutes, until the ice cubes in the grids lose their bond holding them to the grid walls, and fall into the collection bin. The ice-making mode and harvest mode would continuously alternate until such time as no more ice was required. The system would then go into its pump down mode, or shut down. The pump down mode of operation is cycled on and off by the use of a refrigerant (low side) pressure control, that is it will go on at 25 psig and off at 5 psig.

Referring to FIG. 7, there is shown a table of the working solenoid valves for each mode of operation. When the system is in an ice making mode, four-way valve 20 connects line 18 to line 28 and line 14 to accumulator 24, and in the harvest mode, connects line 18 to line 14 and connects line 28 to accumulator 24. Harvest solenoid valve 38 is closed during the ice making mode, and open during the harvest mode. Liquid line solenoid 54 is open during the ice making mode and closed during the harvest mode. In a preferred embodiment, a combination of a refrigerant pressure control, and a preset timer can operate these valves to control the two cycles of operation.

Figure 8:
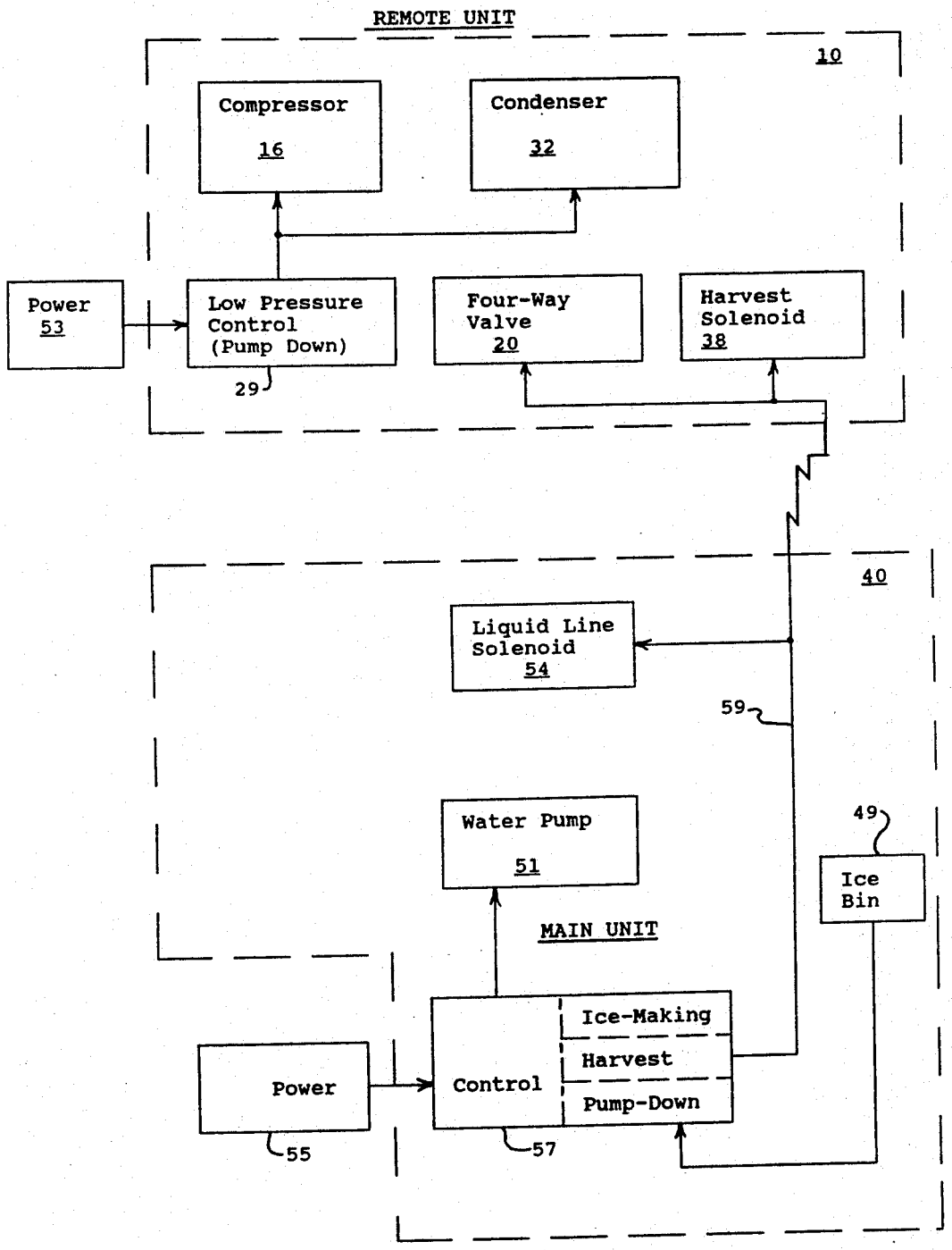
FIG. 8 is an electrical block diagram of the ice-maker system.

FIG. 8 is a block diagram showing one possible method of connecting both the power lines and the control lines to the active components of the main unit 40 and remote unit 10. A power source 55, such as 110 volts or 220 volts, single-phase, can be connected to a control unit 57 which will switch the active components into either the ice-making mode, the ice harvest mode, or the pump down mode. In the ice-making mode, control 57 through control line 59, will operate four-way valve 20, as disclosed in the status diagram of FIG. 7, so as to connect line 18 to line 28 and connect line 14 to accumulator 24 and compressor 16. Harvest solenoid valve 38 will be closed, while liquid line solenoid 54 will be open and both compressor 16 and condenser fan 32 will be operating. Control 57 will also close harvest solenoid valve 38 and will open liquid line solenoid 54 allowing refrigerant to flow into the evaporators. Refrigerant pressure will be sufficient to turn on pressure switch 29, which will supply power 53 to operate both compressor 16 and condenser fan 32. Control unit 57 will also operate water pump 51 to allow water flow over the evaporator during the ice making process.

In order to change over to the ice harvest mode, a timer, or a pressure switch 37 connected to the output of evaporator 60, can determine when the ice-making process has been completed and cause control 57 to switch to its harvest mode. In the harvest mode, water pump 51 will be shut down and the residual water in the collection basin below the evaporators will be flushed out. Compressor 16 and condenser fan 32 will continue to operate while four-way valve 20 switches to connect line 18 to line 14 and to connect line 28 to accumulator 24 and compressor 16. Harvest solenoid valve 38 will then open and liquid line 54 can either remain open or be closed, after receiving operating signals from control line 59.

Control 57 can sense the completion of the ice harvest mode in a number of conventional ways, such as through the use of a refrigerant pressure switch at the output of evaporator 60, a timer set, for example, to 90 seconds, or other means which senses the dropping of the ice into the ice collection bin, as is well known in the prior art. As soon as the ice harvest mode has been completed, control 57 will switch the unit back to the ice-making mode. When the ice bin 49 is full of ice, a trip switch or other device can send a signal to control 57 to switch to the pump-down, so that four-way valve 20 will connect line 18 to line 28 and close solenoids 38 and 54. Compressor 16 and condenser fan 32 will continue to run, storing liquid refrigerant in the receiver, until a pressure switch, such as switch 29 in FIG. 5, connected to the compressor inlet refrigerant line, signals that the proper pressure has been attained. The pressure switch will shut down the compressor and condensor fan. Between using timers, optical devices, pressure and trip switches, et cetera, the different modes can be controlled, as is well known in the ice-making art.

While only a few embodiments of the present invention has been shown and described, it is to be understood that many changes and modifications may be made thereunto without departing from the spirit and scope of the invention as defined in the appended claims.

What is claimed is:

1. An improved ice-maker of the type having an ice-making mode and an ice harvesting mode and including a compressor, a condenser, first and second flow restricters, and an ice-making evaporator wherein the improvement comprises:

a main unit for housing the ice-making evaporator and the first flow restricter;

a remote unit for housing the compressor, the condenser and the second flow restricter coupled to the condenser;

two refrigeration lines connecting said main unit to said remote unit, said first line being an evaporator line which during the ice-making mode is an outlet line, and during the harvest mode is an evaporator inlet line and said second line is a liquid line which feeds refrigerant through the first restricter to the evaporator during the ice-making mode, and during the harvest mode, feeds liquid from the evaporator through the second restricter to the condenser;

a valve means coupled to said first line, said compressor and said condenser;

control means coupled to said valve means wherein, during the ice-making mode, connects the compressor outlet to the condenser, and said evaporator line to the compressor inlet, and during the ice harvest mode, reverses the direction of flow of the refrigerant in said lines and connects the compressor outlet to said evaporator line and the condenser to the compressor inlet so that the condenser serves to evaporate refrigerant and the evaporator serves to condense the refrigerant thereby defrosting the evaporator to facilitate the harvesting of ice; and said valve means additionally includes a harvest solenoid valve coupled to the second flow restricter and a check valve disposed in parallel to said harvest solenoid valve and the second flow restricter, said check valve being closed and said harvest solenoid valve being open during the harvest mode and said check valve being open during the ice-making mode.

2. The improved ice-maker as recited in claim 1 wherein said valve means comprises a four-way valve having a first part connected to the output of the compressor, and a second part connected to the compressor input; a third part connected to the condenser and a fourth part connected to said evaporator line so that during the ice making mode, refrigerant flows from the first part to the third part and from the fourth part to the second part, and during the ice harvest mode, refrigerant flows from the first part to the fourth part, and from the third part to the second part.

3. The ice-maker as recited in claim 1, wherein said main unit additionally comprises a receiver coupled between said liquid line and the first flow restricter, and a second check valve in parallel with said receiver and the first flow restricter, wherein during the ice-making mode, the pressure drop through the first flow restricter holds said second check valve closed, and during the ice harvest mode, said second check valve allows unrestricted flow from the evaporator to said liquid line.

4. The ice-maker as recited in claim 3, additionally including a liquid line solenoid coupled between said receiver and the evaporator, and controlled by said control means for blocking the flow of refrigerant to the evaporator during a pump down mode immediately preceding an off-cycle, and during the off-cycle said control means maintains said harvest solenoid valve shut to prevent migration of liquid refrigerant to the condenser.

5. The ice-maker as recited in claim 4, additionally comprising an ice bin switch coupled to said control means for switching to the pump down mode when said ice bin switch is activated.

6. The ice-maker as recited in claim 5, additionally comprising a further pressure switch coupled to the inlet line of the compressor for shutting off the compressor and the condenser at a predetermined pressure level to end the pump down mode and start the off-cycle.

7. The ice-maker as recited in claim 3 wherein said main unit additionally comprises a third check valve in the liquid line and a fourth check valve in a bypass line from the outlet of the receiver to the liquid line, whereby during harvest mode the refrigerant after it leaves the evaporator is directed into the receiver and from the outlet of the receiver to the liquid line, and during the ice-making mode flows through said third check valve into the receiver and is prevented from bypassing the receiver by said fourth check valve.

8. The ice-maker as recited in claim 7, wherein the quantity of refrigerant circulating in the system during the harvest mode is approximately the same as the quantity of refrigerant circulating during the ice-making mode.

9. An improved ice-maker of the type having an ice-making mode and an ice harvesting mode and including a compressor, a condenser, first and second flow restricters, and an ice-making evaporator wherein the improvement comprises:

a main unit for housing the ice-making evaporator and the first flow restricter;

a remote unit for housing the compressor, the condenser and the second flow restricter coupled to said condenser;

at least two refrigeration lines connecting said main unit to said remote unit, one of said lines being an evaporator line which during the ice-making mode is an outlet line, and during the harvest mode is an evaporator inlet line and said second line is a liquid line which feeds refrigerant through the first restricter to the evaporator during the ice-making mode, and during the harvest mode, feeds liquid from the evaporator through the second restricter to the condenser;

a valve means coupled to said at least two refrigeration lines, said main unit and said remote unit; and control means coupled to said valve means wherein, during the ice-making mode, connects the compressor outlet to the condenser, and the evaporator line to the compressor inlet, and during the ice harvest mode, reverses the direction of flow of the refrigerant in said lines and connects the compressor outlet to the evaporator line and the condenser to the compressor inlet so that the condenser serves to evaporate refrigerant and the evaporator serves to condense the refrigerant thereby defrosting the evaporator to facilitate the harvesting of ice, said valve means includes (a) a four-way valve having a first part connected to the output of the compressor, and a second part connected to the compressor input; a third part connected to the condenser and a fourth part connected to said evaporator line so that during the ice-making mode, refrigerant flows from the first part to the third part and from the fourth part to the second part, and during the ice harvest mode, refrigerant flows from the first part to the fourth part, and from the third part to the second part; and (b) a harvest solenoid valve coupled to the second flow restricter, and a check valve disposed in parallel to said harvest solenoid valve and the second flow restricter, said check valve being closed and said harvest solenoid valve being open during the harvest mode and said check valve being open and said harvest solenoid valve being closed during the ice-making mode.

10. An improved ice-maker of the type having an ice-making mode and an ice harvesting mode and including a compressor, a condenser, first and second flow restricters, and an ice-making evaporator wherein the improvement comprises:

a main unit for housing the ice-making evaporator and the first flow restricter;

a remote unit for housing the compressor, the condenser and the second flow restricter coupled to said condenser;

at least two refrigeration lines connecting said main unit to said remote unit, one of said lines being an evaporator line which during the ice-making mode is an outlet line, and during the harvest mode is an evaporator inlet line and said second line is a liquid line which feeds refrigerant through the first restricter to the evaporator during the ice-making mode, and during the harvest mode, feeds liquid from the evaporator through the second restricter to the condenser;

a valve means coupled to said at least two refrigeration lines, said main unit and said remote unit;

control means coupled to said valve means wherein, during the ice-making mode, connects the compressor outlet to the condenser, and said evaporator line to the compressor inlet, and during the ice harvest mode, reverses the direction of flow of the refrigerant in said lines and connects the compressor outlet to said evaporator line and the condenser to the compressor inlet so that the condenser serves to evaporate refrigerant and the evaporator serves to condense the refrigerant thereby defrosting the evaporator to facilitate the harvesting of ice;

said main unit additionally includes a receiver coupled between said liquid line and the first flow restricter, and the evaporators being connected to the first flow restricter;

said valve means additionally includes a liquid line solenoid coupled between said receiver and said evaporators for blocking the flow of refrigerant to the evaporators during a pump down mode; and a harvest solenoid valve, wherein during pump down mode, said harvest solenoid valve and said liquid line solenoid valve are closed, and refrigerant flows from said evaporator line to the compressor input and from the output of the compressor to the condenser and to said receiver.

11. The ice-maker as recited in claim 10, additionally comprising a pressure switch coupled to said evaporator line, said switch being set at a predetermined level to switch said control means from the ice-making mode to the harvest mode.

12. An improved ice-maker of the type having an ice-making mode and an ice harvesting mode and including a compressor, a condenser, first and second flow restricters, and an ice-making evaporator wherein the improvement comprises:

a main unit for housing the ice-making evaporator and the first flow restricter;

a remote unit for housing the compressor, the condenser and the second flow restricter coupled to said condenser;

at least two refrigeration lines connecting said main unit to said remote unit, one of said lines being an evaporator line which during the ice-making mode is an outlet line, and during the harvest mode is an evaporator inlet line and said second line is a liquid line which feeds refrigerant through the first restricter to the evaporator during the ice-making mode, and during the harvest mode, feeds liquid from the evaporator through the second restricter to the condenser;

a valve means coupled to said at least two refrigeration lines, said main unit and said remote unit;

control means coupled to said valve means wherein, during the ice-making mode, connects the compressor outlet to the condenser, and said evaporator line to the compressor inlet, and during the ice harvest mode, reverses the direction of flow of the refrigerant in said lines and connects the compressor outlet to the evaporator line and the condenser to the compressor inlet so that the condenser serves to evaporate refrigerant and the evaporator serves to condense the refrigerant thereby defrosting the evaporator to facilitate the harvesting of ice;

said main unit additionally includes a receiver coupled between said liquid line and the first flow restricter, and the evaporator being connected to the first flow restricter;

said valve means additionally includes a liquid line solenoid coupled between said receiver and said evaporators for blocking the flow of refrigerant to the evaporators during a pump down mode;

a pressure switch coupled to the inlet line of the compressor for shutting off the compressor and the condenser at a predetermined pressure level during the pump down mode; and an ice bin switch coupled to said control means for switching from the harvest mode to the pump down mode when said ice bin switch is activated.

13. A method of making ice using an ice maker with a remote condensing unit, comprising the steps of:

providing an ice-making cycle with a first check valve allowing unrestricted flow from a condenser to an ice-making unit, and a first automatic valve allowing flow through a restricter into an evaporator;

reversing the flow of refrigerant to provide a harvest cycle with a second check valve allowing unrestricted flow from an evaporator to bypass the first automatic valve and a second automatic valve allowing flow through a restricter into the condenser to bypass the first check valve;

trapping the majority of the refrigerant in a relatively warm receiver during an "off" cycle;

preventing the refrigerant from migrating to the coldest part of the system in order to provide adequate pressure for start up at the beginning of the next ice-making cycle; and closing the automatic valves in response to control means during the off cycle.

14. The method as recited in claim 13, wherein the receiver is located in an interior environment.

15. The method as recited in claim 14, wherein the interior environment is within the main ice-making unit.

* * * * *